United States Patent [19]

Focke et al.

[11] 3,979,047

[45] Sept. 7, 1976

[54] CIGARETTE PACKETS

[75] Inventors: Heinz Focke; Kurt Liedtke, both of Verden, Aller, Germany

[73] Assignee: Focke & Pfuhl, Verden, Aller, Germany

[22] Filed: May 29, 1975

[21] Appl. No.: 581,995

[30] Foreign Application Priority Data

May 29, 1974 Germany ..... 2426131

[52] U.S. Cl. ..... 229/44 CB

[51] Int. Cl.[2] ..... B65D 5/34

[58] Field of Search ..... 229/44 CB

[56] References Cited

UNITED STATES PATENTS

| | | | |
|---|---|---|---|
| 2,661,139 | 12/1953 | Brooks | 229/23 B |
| 2,951,626 | 9/1960 | Weiss | 229/44 CB |
| 2,992,766 | 7/1961 | Guyer | 229/44 CB |
| 3,327,888 | 6/1967 | Chalmers et al. | 229/44 CB X |
| 3,874,581 | 4/1975 | Fox et al. | 229/44 CB |

FOREIGN PATENTS OR APPLICATIONS

| | | | |
|---|---|---|---|
| 1,054,373 | 4/1959 | Germany | 229/44 CB |
| 1,018,781 | 6/1955 | Germany | 229/44 CB |
| 819,205 | 9/1959 | United Kingdom | 229/44 CB |

*Primary Examiner*—Davis T. Moorhead
*Attorney, Agent, or Firm*—Sughrue, Rothwell, Mion, Zinn and Macpeak

[57] ABSTRACT

There is provided a packet of cardboard or similar material, for cigarettes, cigarillos and the like, having a mainly double-layered cover which is articulated to the back wall and, when the box is closed, engages around an inwardly offset collar formed in the zone of the front and side walls and unitary with the basic body member. The collar is provided, at least in relation to the front wall, by Z-shaped folding.

6 Claims, 5 Drawing Figures

CIGARETTE PACKETS

This invention relates to a packet of cardboard or similar material for cigarettes, cigarillos and the like, having a mainly double-layered cover which is articulated to a back wall and, when the box is closed, engages around an inwardly offset collar formed in the zone of the front wall and side walls and unitary with the basic member of the box.

Packets of the kind specified made of paper board, still paper or the like are also known as hard box packets. They are so constructed that the collar around which the lid engages in the closure position of the packet is a separate blank connected to the main blank by gluing. The manufacture of packets of this kind is, therefore, costly in material and complicated.

It is an object of the invention to provide a novel packet of the hard box kind for cigarettes or the like which overcomes or obviates the aforementioned disadvantages.

According to the present invention there is provided a packet of cardboard or similar material for cigarettes, cigarillos or the like, which comprises a mainly double-layered cover which is articulated to a back wall and, when the packet is closed, engages around an inwardly offset collar formed in the zone of front wall and side walls of the packet and unitary with the basic body member of the packet, the collar being offset inwardly in relation to the front wall at least in the zone thereof by Z-shaped folding of the blank from which the packet was formed.

Thus, the packet according to the invention is characterised in that the collar is offset inwardly in relation to the front wall, at least in the zone thereof, by Z-shaped folding. In this way, the collar is clearly limited as against the box body, even though the blank is in one piece. The Z-fold produces a double-layered shoulder which ensures the flush bearing of the also double-layered lid.

Figure 1:
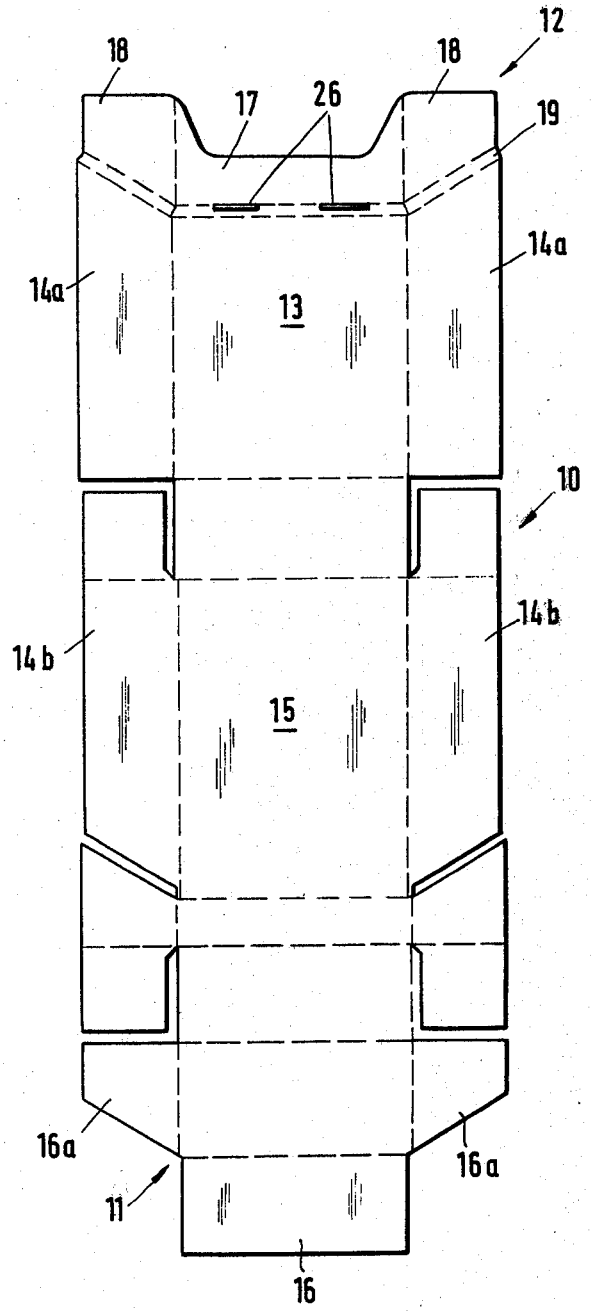
Figure 2:
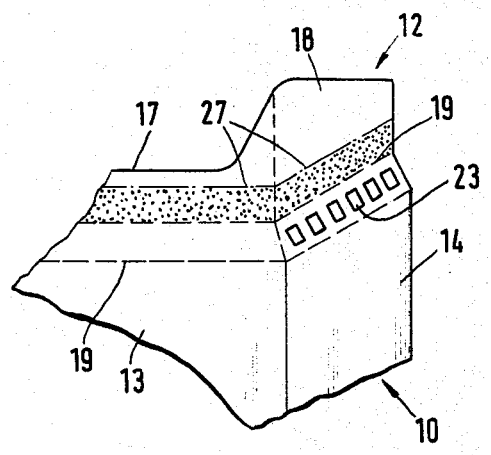
Figure 3:
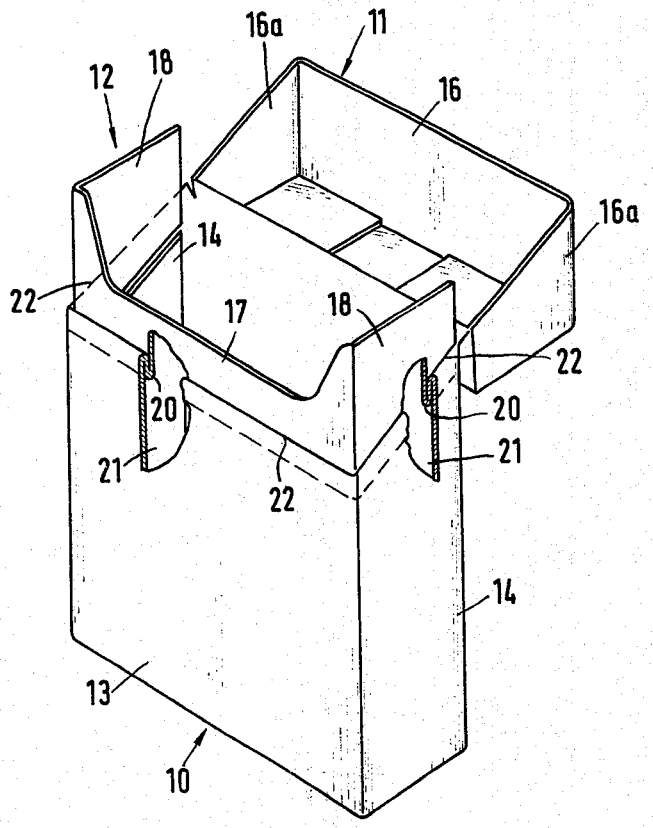
Figure 4:
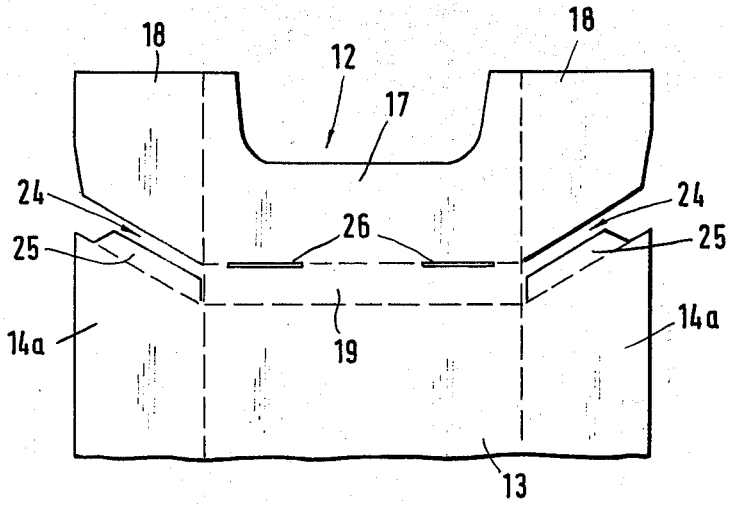
Figure 5:
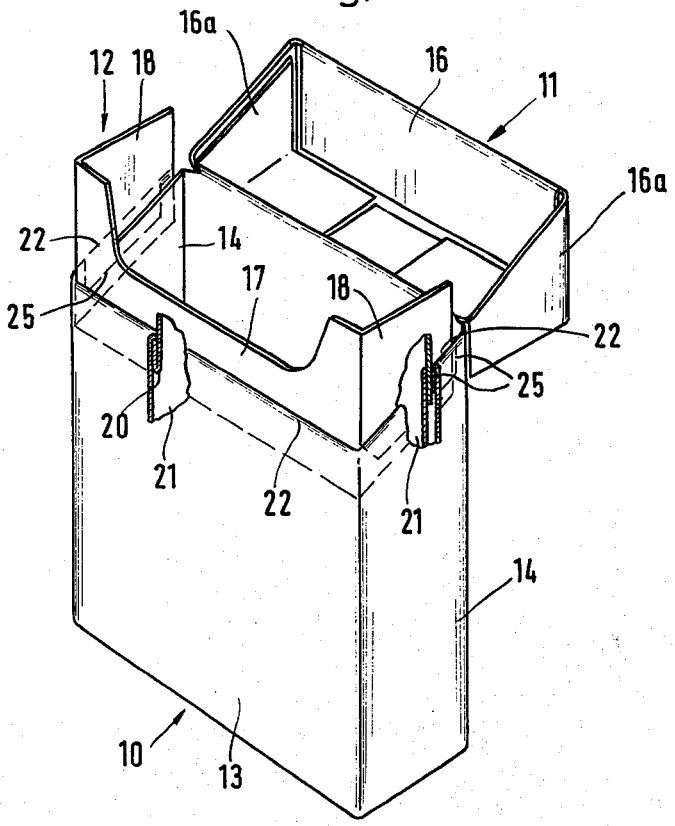

For a better understanding of the present invention and to show how the same may be carried into effect, reference will now be made, by way of example, to the accompanying drawings, in which:

FIG. 1 shows a blank for making a packet according to the invention, in the unfolded condition, FIG. 2 shows a detail, to an enlarged scale, of a blank in the zone of the Z-fold to be formed, for a different embodiment of a packet in accordance with the present invention, FIG. 3 shows a perspective view of an open box made from the blank of FIG. 1, FIG. 4 shows in the unfolded condition that part of a blank of a further embodiment of the packet in accordance with the invention which is intended to form the Z-fold, and FIG. 5 shows a perspective view of a packet as illustrated in FIG. 3, but with a different lid, for the blank illustrated in FIG. 4.

The packets and blanks illustrated in the drawings are hard box cigarette packets or used for the making thereof. Basically a box of the kind specified (see for example FIG. 3) is made up of a body 10 for receiving the cigarettes and a hingeable lid 11 which is articulated to the body 10. Adjoining the top free edge of the body 10 is a collar 12 which is engaged by the lid 11 when the packet is closed.

The packet thus constructed is made from a one-piece blank (see FIG. 1.). The upper portion of the blank shown at the top in FIG. 1 forms a front wall 13 of the body 10 and has side flaps **14*a* which cooperate with side walls 14*b* adjoining a rear wall 15 to form side walls 14 of the packet. The side flaps 14*a* and 14*b* cover one another and are, therefore, connected by gluing. That edge of the rear wall 15 which is at the top in the folded condition is adjoined by flaps, etc., for forming the substantially double-layered lid 11. At least the front wall 16 and the lateral parts 16*a*** are formed from two layers in this embodiment.

That edge of the front wall 13 of the body 10 which is at the top in the folded condition is adjoined by front wall 17 of collar 12. Correspondingly, the side walls 14 of the body 10 are adjoined by side walls 18 of the collar 12. In this embodiment, the flaps for forming the side walls 18 of the collar 12 are offset in relation to the free edges of the side flaps **14*a* for the side walls 14**, to compensate for the displacement of layers when the packet is folded.

The parts of the blank which form the front wall 17 and the side walls 18 are bounded against the adjoining blank parts 13 and **14*a* by a folding strip 19, preferably premarked by folding lines. The folding strip 19 is used for forming a Z-fold 20 which extends across the front wall 13 and the side walls 14 in the embodiment illustrated in FIG. 3. The Z-folding 20 is produced by the folding strip 19 being moved between the correspondingly offset edges of the parts 13 and 14*a* on the one hand and the walls 17 and 18 on the other. The box illustrated in FIG. 3 is broken away at 21 to show the Z-fold 20** in cross-section.

As a transition between the body 10 and the collar 12, the Z-fold 20 produces a closure edge 22 extending forwardly and laterally. The closure edge 22 has the thickness of a double layer of material. The free edge of the lid 11 bears against the closure edge 22, such that the front face of the lid 11 is flush with the front face of body 10.

In the zone of the side walls 14, the closure edge 22 extends at an inclination — that is at an angle to the corner edges of the box. With thin materials and narrow folds, the inclined closure edge 22 can be produced without auxiliary means. However, FIG. 2 illustrates a further development, wherein, near in the zone of the side walls 14 and 18, the folding strip 19 has relief apertures 23, therethrough in the forms of slots oriented parallel to one another. The apertures 23 allow a relative displacement between the side walls 14 and 18 in the Z-fold, so that the latter can be produced without forcing.

FIGS. 4 and 5 illustrate another embodiment in which the folding strip 19 extends only in the zone of the front wall 13 and 17. No Z-folding or a modified one is provided in the zone of the side walls 14 and 18.

As can be seen from FIG. 4, the flaps for forming the side walls 18 of the collar and the side flaps **14*a* on the other are separated from one another by a parting cut 24, which is preferably oblique. The blank can be so constructed that the folding strip 19 between the blank parts 14*a* and 18*a* is completely removed. In the embodiment illustrated, however, a spacing flap 25 is provided which remains connected to the side flap 14*a***. Such a spacing flap is preferably provided in the side flap.

When the packet is being made, due to the Z-folding 20 in the zone of the front wall 13, the blank parts forming the side walls 18 of the collar are displaced in the direction of the side flaps 14*a*, so that their edges register with one another. The spacing flap 25 has already been folded against the inside of the side flap 14*a*. The bottom edge of the side wall can then be connected to the spacing flap 24, with the result that a double-layer closure edge 22 is produced in the zone of the wall 14.

In cross-section, the construction in the zone of the side walls 14 is such that the side walls 18 of the collar 12 are received by the bottom edge, together with the spacing flap 25, between the top edges of the side flaps 14*a*, with 14*b* united to the side wall 14*a*. As a result the collar 12 is very stably connected to the box body 10.

The formation of the Z-fold 20 can be facilitated by providing folding lines bounding the folding strip 19, preferably the inner (bottom) folding line or folding edge in the finished Z-fold, with relieving recesses, such as parallel slots 26.

The registering layers are interconnected in the zone of the Z-fold 20 merely by a strip of glue 27 applied on one side. To take things clearer, the strip of glue 27 is shown only in FIG. 2, the area glued by dotted lines being indicated by dotted lines.

We claim:

1. In a blank for forming a hinged lid packet for cigarettes or the like wherein the blank has integral portions which are folded to form the front, back, sides, bottom and hinged lid of the packet, the improvements comprising:

a. a first pair of parallel fold lines defining a first folding strip extending laterally across the portion of the blank which forms the front of the packet; and b.a second pair of parallel fold lines extending obliquely across the portions of the blank which forms the sides of the packet, one end of the second pair of parallel fold lines coinciding with an end of the first pair of parallel fold lines, said second pair of fold lines defining second folding strips, each of said second folding strips having at least one relief aperture therethrough the relief apertures allowing the blank to be folded in a Z fold about the parallel fold lines to form an inwardly disposed collar portion, about which the hinged lid fits such that outer surfaces of the hinged lid is flush with the outer surfaces of at least the front and sides of the packet.

2. The improved packet of claim 1 wherein the at least one relief aperature in the side portions of the blank define a spacing flap on each of the side portions, the spacing flaps being folded inwardly to provide the requisite inward displacement of the collar portion.

3. The improved packet of claim 1 further comprising interior side flaps foldably attached to the portion of the blank forming the back of the packet, said interior side flaps overlapping the sides of the collar portion when the packet is folded.

4. The improved packet of claim 1 wherein the second folding zones each have a plurality of parallel slots forming the relief apertures.

5. The improved packet of claim 1 wherein the first folding strip has at least one slot therethrough parallel to the fold lines to facilitate folding.

6. The improved packet of claim 1 wherein glue is provided on the first folding strip to retain the Z fold in its folded position.

* * * * *